US009068526B2

(12) United States Patent
Joos et al.

(10) Patent No.: US 9,068,526 B2
(45) **Date of Patent: *Jun. 30, 2015**

(54) METHOD AND CONTROL UNIT FOR OPERATING A VALVE

(75) Inventors: Klaus Joos, Walheim (DE); Jens Neuberg, Stuttgart (DE); Helerson Kemmer, Vaihingen (DE); Holger Rapp, Ditzingen (DE); Haris Hamedovic, Moeglingen (DE); Bernd Wichert, Kernen (DE); Anh-Tuan Hoang, El Paso, TX (US); Ruben Schlueter, Stuttgart (DE); Joerg Koenig, Stuttgart (DE); Achim Hirchenhein, Trierweiler (DE)

(73) Assignee: ROBERT BOSCH GMBH, Stuttgart (DE)

( * ) Notice: Subject to any disclaimer, the term of this patent is extended or adjusted under 35 U.S.C. 154(b) by 473 days.

This patent is subject to a terminal disclaimer.

(21) Appl. No.: 13/515,732

(22) PCT Filed: Dec. 2, 2010

(86) PCT No.: PCT/EP2010/068702

§ 371 (c)(1),
(2), (4) Date: Sep. 26, 2012

(87) PCT Pub. No.: WO2011/082901

PCT Pub. Date: Jul. 14, 2011

(65) Prior Publication Data

US 2013/0013170 A1 Jan. 10, 2013

(30) Foreign Application Priority Data

Dec. 14, 2009 (DE) ..... 10 2009 054 588

(51) Int. Cl.
*F02D 41/26* (2006.01)
*F02D 41/20* (2006.01)

(Continued)

(52) U.S. Cl.
CPC ..... *F02D 41/20* (2013.01); *F02D 41/2432* (2013.01); *F02D 41/247* (2013.01);
(Continued)

(58) Field of Classification Search
CPC ..... F02D 41/20; F02D 41/22; F02D 41/26; F02D 2041/2037; F02D 41/247; F02D 41/2432
USPC ..... 701/103–105, 107; 123/490, 478, 479, 123/480, 482; 73/114.45
See application file for complete search history.

(56) References Cited

U.S. PATENT DOCUMENTS

| | | | | |
|---|---|---|---|---|
| 2003/0071613 | A1* | 4/2003 | Schultz et al. | 324/207.16 |
| 2007/0041131 | A1* | 2/2007 | Kesselgruber et al. | 360/256.2 |
| 2007/0139047 | A1* | 6/2007 | Ostman | 324/418 |
| 2012/0291757 | A1* | 11/2012 | Joos et al. | 123/480 |

FOREIGN PATENT DOCUMENTS

| | | |
|---|---|---|
| CN | 101238281 | 8/2008 |
| CN | 101529070 | 9/2009 |

(Continued)

*Primary Examiner* — Hai Huynh
(74) *Attorney, Agent, or Firm* — Kenyon & Kenyon LLP

(57) ABSTRACT

A method for operating a valve, in particular a fuel injector of an internal combustion engine of a motor vehicle, in which an auxiliary variable is obtained as a function of at least one electrical operating variable of an electromagnetic actuator driving a component of the valve, in particular a valve needle, and in which the auxiliary variable is checked for the presence of a predefinable characteristic. A reference variable is ascertained as a function of the auxiliary variable, the auxiliary variable is modified as a function of the reference variable to obtain a modified auxiliary variable, and the modified auxiliary variable is checked for the presence of the predefinable characteristic.

11 Claims, 5 Drawing Sheets

(51) Int. Cl.

| | |
|---|---|
| ***F02D 41/24*** | (2006.01) |
| ***H01F 7/18*** | (2006.01) |
| *F02D 41/14* | (2006.01) |

(52) U.S. Cl.
CPC . *F02D2041/1433* (2013.01); *F02D 2041/2037* (2013.01); *F02D 2041/2055* (2013.01); *H01F 7/1844* (2013.01)

(56) References Cited

FOREIGN PATENT DOCUMENTS

| | | |
|---|---|---|
| DE | 10 2005 038934 | 2/2007 |
| EP | 1 302 952 | 4/2003 |
| WO | 2004/102600 | 11/2004 |
| WO | 2011/003704 | 1/2011 |

* cited by examiner

METHOD AND CONTROL UNIT FOR OPERATING A VALVE

FIELD OF THE INVENTION

The present invention relates to a method for operating a valve, in particular a fuel injector of an internal combustion engine of a motor vehicle, in which an auxiliary variable is obtained as a function of at least one electrical operating variable of an electromagnetic actuator driving a component of the valve, in particular a valve needle, and in which the auxiliary variable is checked for the presence of a predefinable characteristic. The present invention also relates to a control unit for operating a valve of this type.

BACKGROUND INFORMATION

Methods and devices of the aforementioned type may be used to obtain information about an operating state of the valve. Particularly important changes in the operating state, for example a transition from an open state to a closed state, are derivable from extremes of a time characteristic of the auxiliary variable, at least in some operating modes or points of conventional injectors.

However, the evaluation accuracy of such methods is often insufficient, in particular in the event of short activation times and/or minimal valve lifts.

SUMMARY OF THE INVENTION

An object of the exemplary embodiments and/or exemplary methods of the present invention is therefore to improve a method and a control unit of the type mentioned at the outset in such a way that a more precise evaluation and the obtaining of information on an operating state are possible even in the event of minimal valve lifts.

According to the exemplary embodiments and/or exemplary methods of the present invention, this object is achieved using a method of the type mentioned at the outset by ascertaining a reference variable as a function of the auxiliary variable, by modifying the auxiliary variable as a function of the reference variable to obtain a modified auxiliary variable, and by checking the modified auxiliary variable for the presence of the predefinable characteristic.

Studies by the applicant have shown that preparing the auxiliary variable in this way according to the exemplary embodiments and/or exemplary methods of the present invention, which may also be referred to as self-reference formation, allows for a particularly precise evaluation, thus providing high evaluation accuracy with regard to detecting changes in the operating state of the valve, in particular in the event of short activation times or minimal valve lifts.

According to one variant of the exemplary embodiments and/or exemplary methods of the present invention, a time characteristic of an actuator voltage or an actuator current is particularly advantageously used as the at least one electrical operating variable for forming the auxiliary variable, i.e., a time characteristic of an electrical voltage applied to a solenoid coil of an electromagnetic actuator or a time characteristic of the current flowing through the solenoid coil.

According to another advantageous variant of the exemplary embodiments and/or exemplary methods of the present invention, a particularly efficient evaluation is provided if the reference variable is obtained from the time characteristic of the auxiliary variable with the aid of a smoothing method, in particular by forming a mean value or by low pass filtering.

According to another variant of the exemplary embodiments and/or exemplary methods of the present invention, the reference variable is particularly advantageously obtained as a varying mean value of the auxiliary variable.

Another very advantageous variant of the present invention provides that the modified auxiliary variable is obtained in that the reference variable is subtracted from the auxiliary variable, thus imposing particularly minimal requirements on a control unit which carries out the method according to the present invention or on a processor included therein.

According to another advantageous variant of the exemplary embodiments and/or exemplary methods of the present invention, it is furthermore possible to divide a difference between the auxiliary variable and the reference variable by the auxiliary variable and/or the reference variable to obtain the modified auxiliary variable.

It is furthermore conceivable to weight a difference between the auxiliary variable and the reference variable with an additional reference variable which is, in particular, non-constant over time, to obtain the modified auxiliary variable.

The additional reference variable may be formed, for example, as a function of:

a. the auxiliary variable and/or the reference variable, and/or
b. a change over time in the auxiliary variable and/or the reference variable, and/or
c. a time distance of a change in the state of an electrical control variable of the actuator.

The use of an additional reference variable advantageously allows for an improved adaptation of the method according to the present invention to the specific configuration of a relevant valve type or a control signal provided therefor.

According to another very advantageous variant of the present invention, the reference variable according to the present invention, as well as the additional reference variable, may be derived from the auxiliary variable in real time. This means that, once a sufficient number of corresponding sampled values of the auxiliary variable examined according to the present invention have been detected, for example by measurement, corresponding values of the reference variable formed according to the present invention may be ascertained from these sampled values of the auxiliary variable, so that a, so to speak, continuous ascertainment of both the reference variable and the modified auxiliary variable is achieved. This advantageously makes it possible to dispense with long storage of the reference variable ascertained according to the present invention and/or of the modified auxiliary variable. Instead, these variables may be ascertained in real time—if necessary—and are thus always up to date. The minimal computing power requirements that the principle of the present invention imposes on the arithmetic power of the processor carrying out the method further improves the real-time capability of the present invention.

An object of the present invention is furthermore achieved by a control and/or regulating system according to the description herein.

It is of particular interest to implement the operating method according to the present invention in the form of a computer program which may be stored on an electronic and/or optical storage medium and which is executable by a control and/or regulating system, e.g., for an internal combustion engine.

Additional advantages, features and details are derived from the following description, in which different exemplary embodiments of the present invention are illustrated with reference to the drawing. The features described herein and in the further descriptions may each be important for the present system and/or method either individually or in any combination.

DETAILED DESCRIPTION

Figure 1:
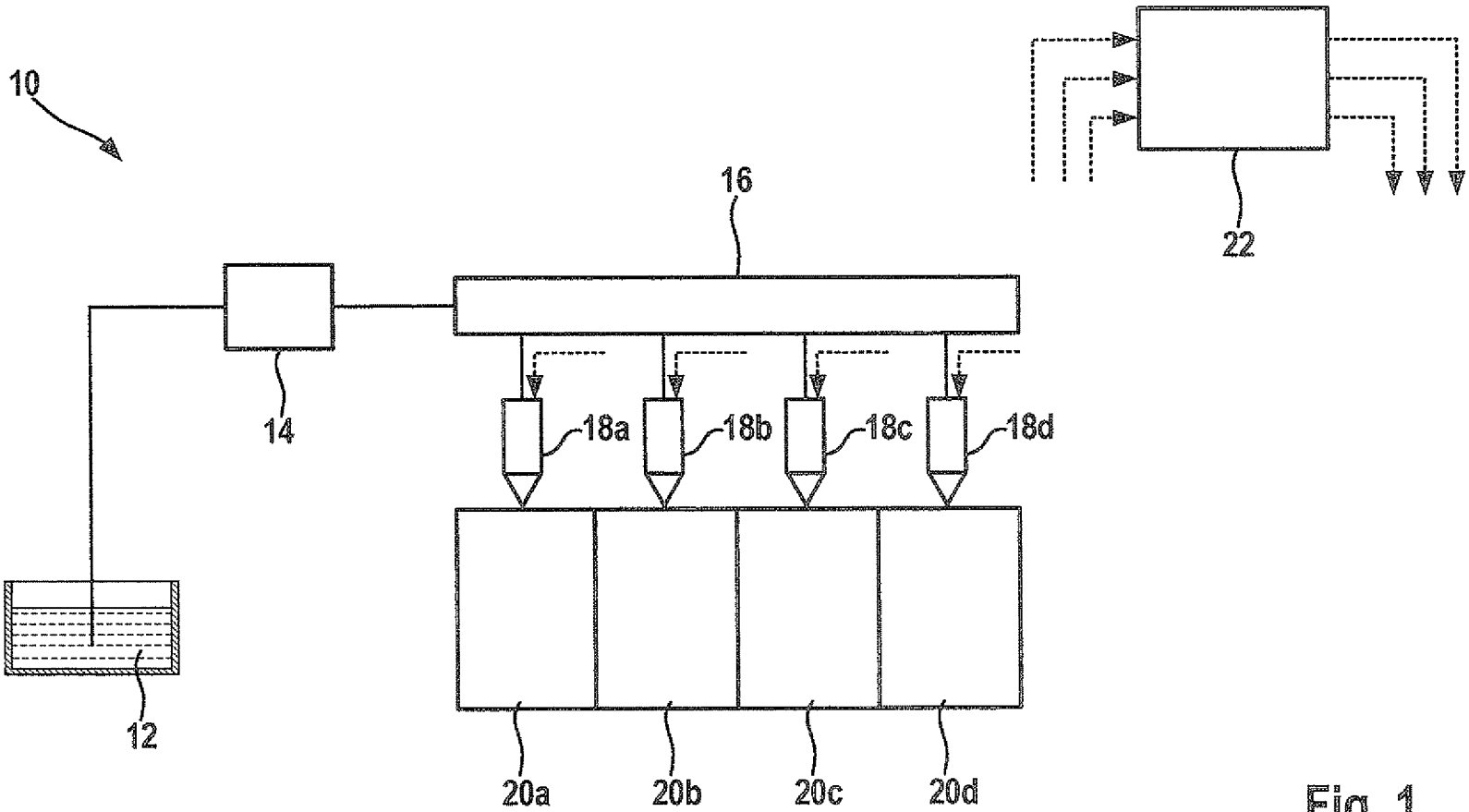
FIG. 1 shows a schematic representation of an internal combustion engine having multiple injectors operated according to the present invention.

In FIG. 1, an internal combustion engine is identified as a whole by reference numeral 10. It includes a tank 12 from which a delivery system 14 delivers fuel to a common rail 16. Multiple electromagnetically actuated injectors 18*a* through 18*d*, which inject the fuel directly into combustion chambers 20*a* through 20*d* assigned to them, are connected thereto. The operation of internal combustion engine 10 is controlled or regulated by a control and regulating system 22, which activates injectors 18*a* through 18*d*, among other things.

Figure 2C:
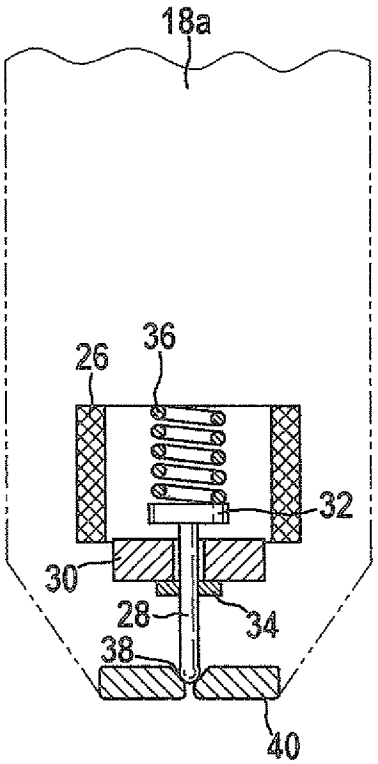
FIGS. 2*a*, 2*b*, and 2*c* show schematic representations of a detailed view of an injector from FIG. 1 in three different operating states.
Figure 2B:
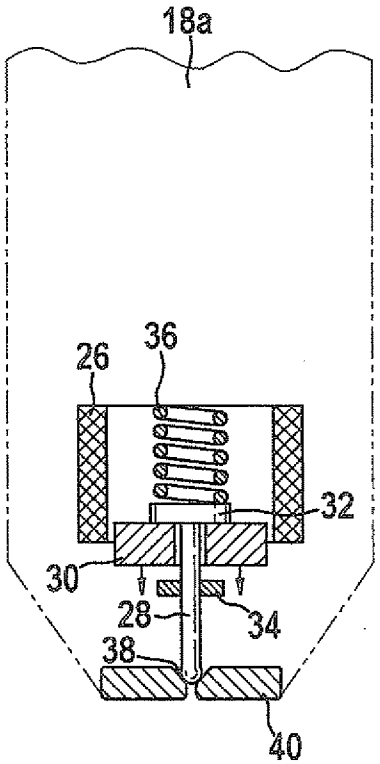
Figure 2A:
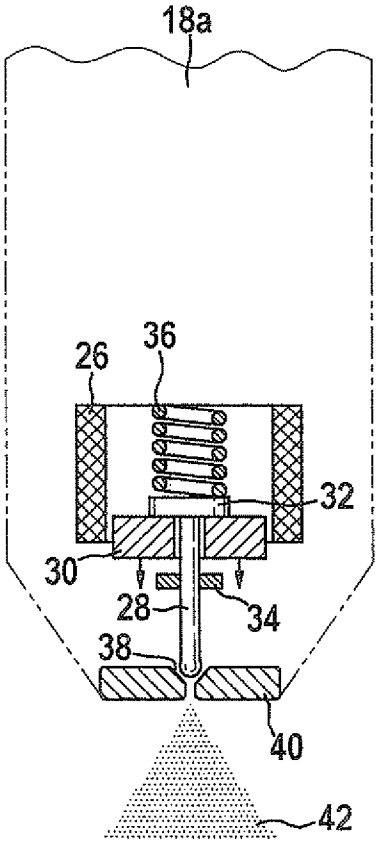

FIGS. 2*a* through 2*c* show schematic representations of injector 18*a* according to FIG. 1 in a total of three different operating states. The other injectors 18*b*, 18*c*, 18*d*, which are illustrated in FIG. 1, have a corresponding structure and functionality.

Injector 18*a* has an electromagnetic actuator which includes a solenoid coil 26 and a solenoid armature 30 which cooperates with solenoid coil 26. Solenoid armature 30 is connected to a valve needle 28 of injector 18*a* in such a way that it is movable relative to valve needle 28 in a non-vanishing mechanical clearance in relation to a vertical direction of movement of valve needle 28 in FIG. 2*a*.

This results in a two-part mass system 28, 30, which drives valve needle 28 with the aid of electromagnetic actuator 26, 30. This two-part configuration improves the mountability of injector 18*a* and reduces undesirable rebounding of valve needle 28 when it strikes its valve seat 38.

In the present configuration illustrated in FIG. 2*a*, the axial clearance of solenoid armature 30 on valve needle 28 is limited by two stops 32 and 34. However, at least lower stop 34 in FIG. 2*a* could be implemented in the form of an area of the housing of injector 18*a*.

As shown in FIG. 2*a*, a corresponding elastic force against valve seat 38 is applied to valve needle 28 in the area of housing 40 by a valve spring 36. In FIG. 2*a*, injector 18*a* is shown in its open state. In this open state, solenoid armature 30 is moved upward by an energization of solenoid coil 26 in FIG. 2*a*, so that it moves valve needle 28 out of its valve seat 38 against the elastic force by engaging with stop 32. This enables fuel 42 to be injected into combustion chamber 20*a* (FIG. 1) by injector 18*a*.

As soon as the energization of solenoid coil 26 by control unit 22 (FIG. 1) is ended, valve needle 28 moves toward its valve seat 38 under the effect of the elastic force applied by valve spring 36, and carries solenoid armature 30 along with it. A transmission of force from valve needle 28 to solenoid armature 30 again takes place with the aid of upper stop 32.

As soon as valve needle 28 ends its closing movement by striking valve seat 38, solenoid armature 30 may continue to move downward, as shown in FIG. 2*b*, due to the axial clearance in FIG. 2*b*, until it rests against second stop 34, as illustrated in FIG. 2*c*.

Figure 3:
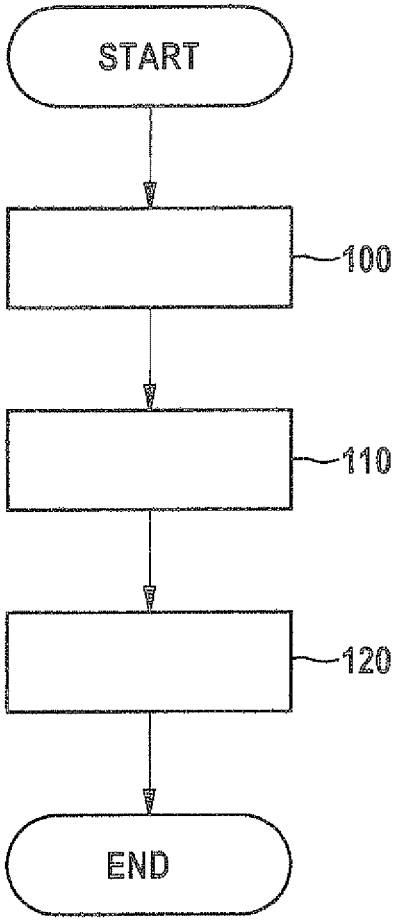
FIG. 3 shows a simplified flow chart of a specific embodiment of the method according to the present invention.

According to the present invention, the method described below with reference to the flow chart according to FIG. 3 is carried out to obtain particularly precise information about an operating state or a change in the operating state of injector 18*a*.

In a first step 100 of the method according to the present invention, an electrical operating variable of electromagnetic actuator 26, 30 (FIG. 2*a*), for example the actuator voltage in the present case, which is applied to solenoid coil 26 of the actuator, is detected. This may take place with the aid of a measuring instrument integrated into control unit 22 (FIG. 1) in a manner which is known per se. An auxiliary variable m (FIG. 5) is then formed as a function of actuator voltage u, also in step 100.

In the simplest case, auxiliary variable m may be identical to the actuator voltage. However, auxiliary variable m may also be generally obtained as a function of the actuator voltage and/or the actuator current flowing through solenoid coil 26. A filtering as well as other common signal processing methods may also be used to obtain auxiliary variable m from the actuator voltage and/or the actuator current.

In a subsequent step 110, a reference variable mref (FIG. 5) is ascertained as a function of auxiliary variable m.

Figure 5:
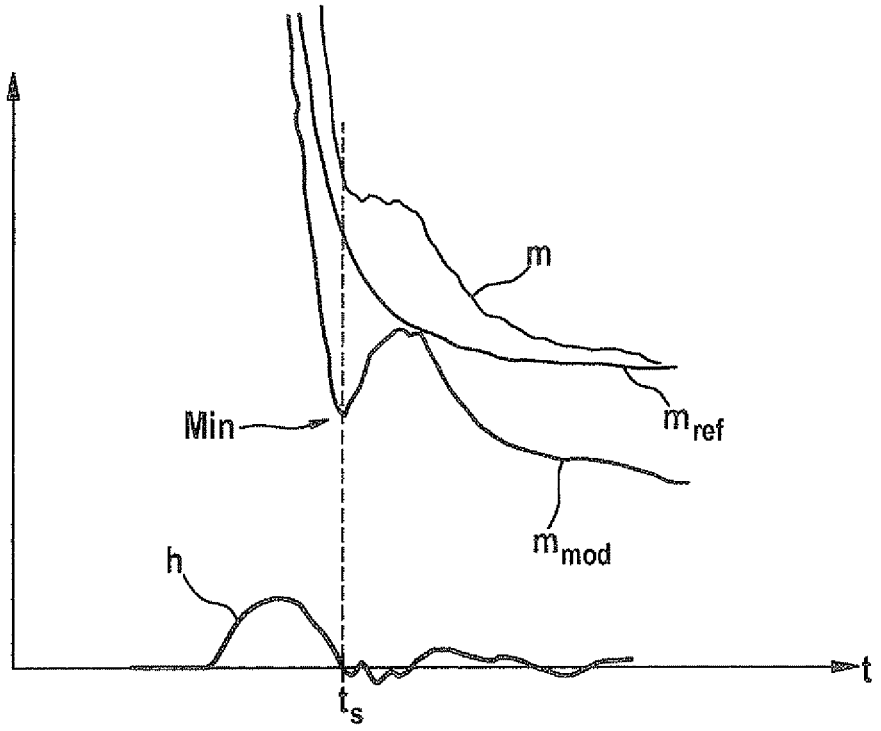
FIG. 5 shows a time characteristic of an auxiliary variable obtained from an electrical operating variable of the valve from FIG. 2*a* as well as variables derived therefrom according to the present invention.

In step 120 of the method according to the present invention, auxiliary variable m is subsequently modified as a function of reference variable mref to obtain a modified auxiliary variable mmod (FIG. 5).

According to studies by the applicant, auxiliary variable mmod, which is modified in the manner described above, has a particularly strong correlation with important changes in the operating state of valve 18*a* and is therefore ideally suited to detecting such changes in the operating state.

In particular, it is possible, by forming the modified auxiliary variable, to extremely precisely ascertain a hydraulic closing point in time of valve 18*a* at which valve needle 28 reaches its closed position in the area of the injection holes or of valve seat 38.

Figure 4:
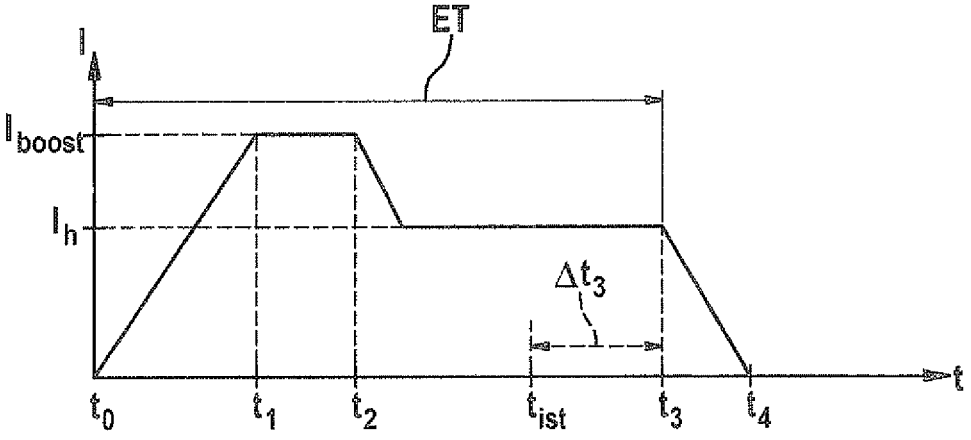
FIG. 4 shows a schematic representation of a time characteristic of an activating current for a valve operated according to the present invention.

FIG. 4 shows a schematic representation of an exemplary time characteristic of an activating current I for electromagnetic actuator 26, 30 (FIG. 2*a*) of valve 18*a* during an activation for a fuel injection.

To enable valve 18*a* to open rapidly from its closed state at t=t0, activating current I is increased from point in time t0, which corresponds to the activation start from value I=0 to booster current Iboost. Booster current Iboost is reached at point in time t1. The booster current is maintained until subsequent point in time t2.

It may be assumed that valve 18*a* has reached its open state at end t2 of the so-called booster phase, which lies between point in time t0 and point in time t2. To continue to keep the valve open at points in time t t2, activating current I is now reduced not to zero but to so-called holding current Ih.

According to FIG. 4, holding current Ih is maintained until point in time t3. Time difference t3−t0 defines total electrical activation time ET of valve 18*a* or its electromagnetic actuator 26, 30.

At the end of activation time ET, i.e., starting at t=t3, control unit 22 no longer applies an activating current or a corresponding activating voltage to electromagnetic actuator 26, 30, so that the activating current still present finally decreases to zero by point in time t4, according to the laws of induction.

Point in time tactual, which is also shown in FIG. 4, represents a point in time within activation time ET, which is examined by way of example and whose time distance Δt3 of the change in the state of activating current I at t=t3 (end of energization) is important for a variant of the method according to the present invention which is described below.

FIG. 5 shows a time characteristic of needle lift h of valve needle 28 (FIG. 2*a*), which results during an activation according to activating current characteristic I described above (see FIG. 4) at very short electrical activation times ET.

In activation operations of this type, in which a relatively short activation time ET or a relatively small maximum valve lift h is present, auxiliary variable m usually does not have any characteristics which may be very easily and directly evaluated to reliably determine actual hydraulic closing point in time ts (FIG. 5). At actual closing point in time ts, auxiliary variable m examined according to the present invention has a non-vanishing curvature in the present case, but not a local extreme which is easily detectable, for example.

The representation of the variables shown in FIG. 5 is not true to scale. In particular, auxiliary variable m may indeed have a far less significant characteristic at point in time ts than is shown in the present illustration in FIG. 5.

Using the principle according to the present invention, a reference variable mref is therefore formed as a function of auxiliary variable m to permit an efficient evaluation of auxiliary variable m.

According to a particularly simple variant of the present invention, reference variable mref may be obtained, for example, as a varying mean value of auxiliary variable m.

A modification of auxiliary variable m according to the present invention with the aid of reference variable mref, which is also referred to as a self-reference due to its ascertainment from auxiliary variable m itself, results in modified auxiliary variable mmod, which has a pronounced local minimum Min at closing point in time ts, as shown in FIG. 5.

Accordingly, the formation of reference variable mref according to the present invention and the subsequent modification of auxiliary variable m as a function of reference variable mref, whereby a modified auxiliary variable mmod is obtained, advantageously permit a simple evaluation of auxiliary variable m or modified auxiliary variable mmod for the presence of a change in the operating state, such as the closing operation of valve 18*a* described above.

According to studies by the applicant, the principle according to the present invention has proven to be particularly reliable, in particular at relatively short activation times ET as well as relatively small maximum needle lifts h.

In general, a smoothing method may be advantageously used to obtain reference variable mref from the time characteristic of auxiliary variable m.

The variables described above—auxiliary variable m, reference variable mref, modified auxiliary variable mmod—may be a corresponding time characteristic of the relevant variables. In one embodiment of the operating method according to the present invention, a sufficiently high sampling rate for the respective variables m, mref, mmod must be selected according to the desired precision, with the aid of digital signal processing.

According to the exemplary embodiments and/or exemplary methods of the present invention, a low pass filtering may also be advantageously used to ascertain reference variable mref from auxiliary variable m. The low pass filter arrangement used for this purpose may be parameterized linearly or nonlinearly and be provided in both analog and digital form.

A formation of modified auxiliary variable mmod which requires particularly little computing complexity is achieved in that reference variable mref is subtracted from auxiliary variable m.

According to the exemplary embodiments and/or exemplary methods of the present invention, it may furthermore be provided that a difference diff is obtained according to:

$$\mathrm{diff}=m-m\mathrm{ref}$$

which, in turn, is divided by auxiliary variable m and/or reference variable mref to obtain modified auxiliary variable mmod, for example:

$$m\mathrm{mod}=(m-m\mathrm{ref})/m.$$

It is furthermore conceivable to weight difference diff between auxiliary variable m and reference variable mref with an additional reference variable which may be also non-constant over time.

The additional reference variable may be formed as a function of auxiliary variable m and/or reference variable mref and/or the changes thereof over time or as a function of a time distance of a change in the state of an electrical control variable of actuator 26, 30, for example instantaneous distance Δt3 (FIG. 4), from the planned end of energization (t=t3), in relation to an examined point in time tactual.

Figure 6A:
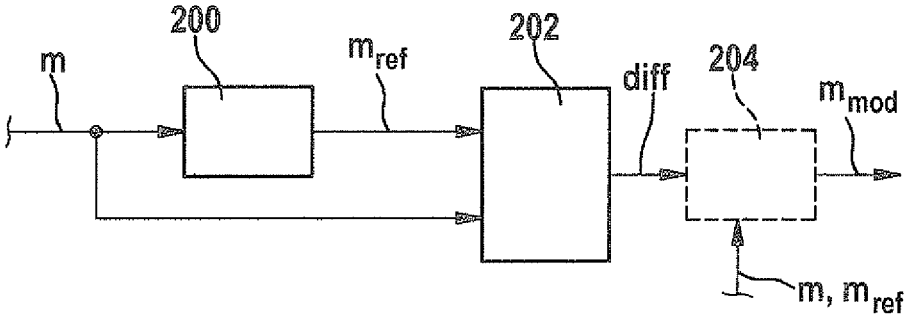
FIG. 6*a* shows a function diagram for implementing different variants of the method according to the present invention.

FIG. 6*a* shows a block diagram of an arithmetic structure by way of example for ascertaining modified auxiliary variable mmod according to the exemplary embodiments and/or exemplary methods of the present invention. A reference variable mref is formed from auxiliary variable m with the aid of a first function block 200, which is an averager or a low pass in the present case.

In the simplest case, auxiliary variable m may be identical to the actuator voltage, as described previously. However, auxiliary variable m may also be generally obtained as a function of the actuator voltage and/or the actuator current flowing through solenoid coil 26. A filtering as well as other common signal processing methods may also be used to obtain auxiliary variable m from the actuator voltage and/or the actuator current.

Reference variable mref and auxiliary variable m itself are then supplied to subtractor 202, which ascertains difference diff=m−mref therefrom.

In a very simple specific embodiment of the present invention, difference diff may be used directly as a modified auxiliary variable mmod to be checked for an interesting characteristic, e.g., a local minimum Min (FIG. 5).

Alternatively thereto, difference diff may be divided by at least one of variables m, mref in function block 204 to obtain modified auxiliary variable mmod.

Figure 6B:
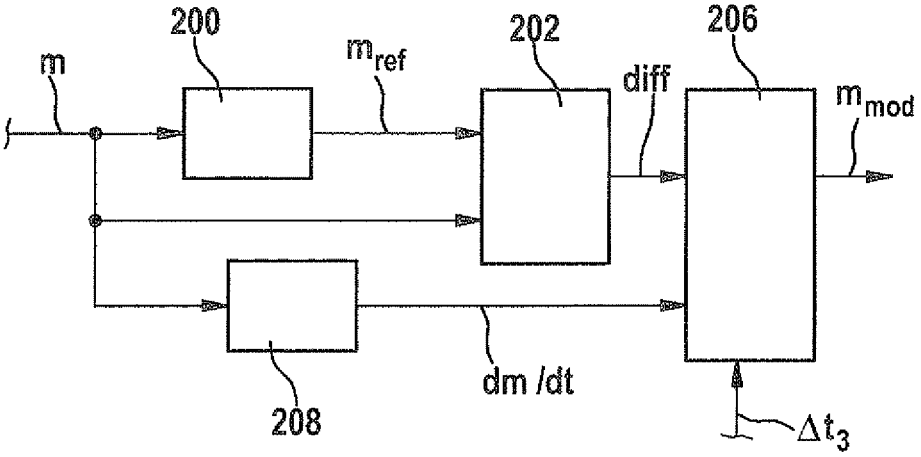
FIG. 6*b* shows another function diagram for implementing different variants of the method according to the present invention.

FIG. 6*b* shows an additional block diagram of an arithmetic structure by way of example for ascertaining modified auxiliary variable mmod according to the exemplary embodiments and/or exemplary methods of the present invention. In contrast to FIG. 6*a*, a time derivation dm/dt of auxiliary variable m is formed by subtractor 208 and supplied to function block 206 along with difference diff and instantaneous time distance Δt3 at the end of the latest energization (at t=t3, FIG. 4). Function block 206 weights difference diff as a function of its two other input variables dm/dt, Δt3.

Additional variants of the method according to the present invention are conceivable, in particular, the evaluation algorithm being adapted to a valve-typical characteristic of auxiliary variable m to be checked.

Although the method according to the present invention is illustrated by three consecutive steps 100, 110, 120, with reference to FIG. 3, reference variable mref may be particularly advantageously formed in real time, i.e., as soon as one or multiple new values of auxiliary variable m is/are present, relevant values of the reference variable may be formed as a function hereof, according to the above aspects of the method. The same applies to the formation of modified auxiliary variable mmod from variables m, mref. As a result, the storage of the relevant values may be advantageously dispensed with, and instead the latest values may always be ascertained, as needed, from variable m.

For example, reference variable mref may also be obtained in the sense of a mean value formation according to the following equation:

$$m\mathrm{ref}(t)=0.5\cdot(m(t-\Delta t1)+m(t+\Delta t2)),$$

where Δt1 and Δt2 may have different values. It is furthermore possible to select the same value for Δt1 and Δt2.

The exemplary embodiments and/or exemplary methods of the present invention work regardless of whether a reference variable mref is first calculated and this reference variable is then, for example, subtracted from auxiliary variable m, or whether modified auxiliary variable mmod is determined directly from auxiliary variable m in one mathematical procedure.

What is claimed is:

1. A method for operating a valve, which is a fuel injector of an internal combustion engine of a motor vehicle, the method comprising:

obtaining an auxiliary variable as a function of at least one electrical operating variable of an electromagnetic actuator driving a component of the valve, which is a valve needle;

checking the auxiliary variable for the presence of a predefinable characteristic;

ascertaining a reference variable as a function of the auxiliary variable;

modifying, the auxiliary variable as a function of the reference variable to obtain a modified auxiliary variable; and checking the modified auxiliary variable for the presence of the predefinable characteristic.

2. The method of claim 1, wherein a time characteristic of an actuator voltage or an actuator current is used as at least one electrical operating variable for forming the auxiliary variable.

3. The method of claim 1, wherein the reference variable is obtained from the time characteristic of the auxiliary variable with the aid of a smoothing method, with the aid of a mean value formation or a low pass filtering.

4. The method of claim 1, wherein the modified auxiliary variable is obtained in that the reference variable is subtracted from the auxiliary variable.

5. The method of claim 4, wherein a difference between the auxiliary variable and the reference variable is divided by the auxiliary variable and/or the reference variable to obtain the modified auxiliary variable.

6. The method of claim 4, wherein a difference between the auxiliary variable and the reference variable is weighted with an additional reference variable, which is non-constant over time, to obtain the modified auxiliary variable.

7. The method of claim 6, wherein the additional reference variable is formed as a function of at least one of:

a. at least one of the auxiliary variable and the reference variable, b. a change over time in the auxiliary variable and the reference variable, and c. a time distance of a change in the state of an electrical control variable of the actuator.

8. The method of claim 1, wherein the reference variable is derived from the auxiliary variable in real time.

9. A computer readable medium having a computer program, which is executable by a processor, comprising:

a program code arrangement having program code for operating a valve, which is a fuel injector of an internal combustion engine of a motor vehicle, by performing the following:

obtaining an auxiliary variable as a function of at least one electrical operating variable of an electromagnetic actuator driving a component of the valve, which is a valve needle;

checking the auxiliary variable for the presence of a predefinable characteristic;

ascertaining a reference variable as a function of the auxiliary variable;

modifying, the auxiliary variable as a function of the reference variable to obtain a modified auxiliary variable; and checking the modified auxiliary variable for the presence of the predefinable characteristic.

10. The computer readable medium of claim 9, wherein the computer readable medium is an electrical storage medium or an optical storage medium.

11. A control and/or regulating system for operating a valve, which is a fuel injector of an internal combustion engine of a motor vehicle, comprising:

a control and/or regulating arrangement configured to perform the following:

obtaining an auxiliary variable as a function of at least one electrical operating variable of an electromagnetic actuator driving a component of the valve, which is a valve needle;

checking the auxiliary variable for the presence of a predefinable characteristic;

ascertaining a reference variable as a function of the auxiliary variable;

modifying, the auxiliary variable as a function of the reference variable to obtain a modified auxiliary variable; and checking the modified auxiliary variable for the presence of the predefinable characteristic.

* * * * *